US007922407B2

(12) United States Patent
Hoffman

(10) Patent No.: US 7,922,407 B2
(45) Date of Patent: Apr. 12, 2011

(54) CREDENTIAL PRODUCTION PRINT RIBBON AND TRANSFER RIBBON CARTRIDGES

(75) Inventor: Ted M. Hoffman, Eden Prairie, MN (US)

(73) Assignee: HID Global Corporation, Irvine, CA (US)

( * ) Notice: Subject to any disclaimer, the term of this patent is extended or adjusted under 35 U.S.C. 154(b) by 376 days.

(21) Appl. No.: 11/683,816

(22) Filed: Mar. 8, 2007

(65) Prior Publication Data

US 2008/0219739 A1 Sep. 11, 2008

(51) Int. Cl.
*B41J 35/28* (2006.01)

(52) U.S. Cl. ..... 400/208; 347/214; 400/693.1

(58) Field of Classification Search ..... 400/207; 347/214

See application file for complete search history.

(56) References Cited

U.S. PATENT DOCUMENTS

| | | | | |
|---|---|---|---|---|
| 2,401,719 | A | 6/1946 | Braun | |
| 3,513,957 | A * | 5/1970 | Sandrone et al. | 400/208 |
| 3,731,781 | A * | 5/1973 | Caudill et al. | 400/208 |
| 3,933,350 | A | 1/1976 | Mignano | |
| 3,948,506 | A | 4/1976 | Crimmins et al. | |
| 3,961,785 | A | 6/1976 | Gall | |
| 3,975,010 | A | 8/1976 | Schisselbauer et al. | |
| 4,299,504 | A * | 11/1981 | Benz et al. | 400/208 |
| 4,305,577 | A | 12/1981 | Clay et al. | |
| 4,350,454 | A | 9/1982 | Schoenlein | |
| 4,458,890 | A | 7/1984 | Kawazu | |
| 4,527,149 | A | 7/1985 | Swensen | |
| 4,568,074 | A | 2/1986 | Murayoshi | |
| 4,590,486 | A | 5/1986 | Yana | |
| 4,592,634 | A | 6/1986 | Koch | |
| 4,607,832 | A | 8/1986 | Abe | |
| 4,609,298 | A * | 9/1986 | Shioda | 400/208 |
| 4,615,628 | A * | 10/1986 | Swinburne | 400/207 |
| 4,685,815 | A | 8/1987 | Baranyi | |
| 4,687,358 | A | 8/1987 | Saitou | |
| 4,869,455 | A | 9/1989 | Weeks | |
| 4,938,616 | A | 7/1990 | Shiozaki et al. | |

(Continued)

FOREIGN PATENT DOCUMENTS

JP 07040615 A 2/1995

(Continued)

OTHER PUBLICATIONS

Search Report and Written opinion dated May 30, 2008 for International Application No. PCT/US2008/000853.

(Continued)

*Primary Examiner* — Jill E Culler
(74) *Attorney, Agent, or Firm* — Leanne Taveggia Farrell; Westman, Champlin & Kelly, P.A.

(57) ABSTRACT

A ribbon cartridge for use in a credential production device is disclosed. The ribbon cartridge includes a take-up spool, a supply spool and a ribbon wound on the supply and take-up spools. The supply spool includes a loaded condition, in which a majority of the ribbon is wound on the supply spool and a minority of the ribbon is wound on the take-up spool. The take-up spool includes a loaded condition, in which a majority of the ribbon is wound on the take-up spool and a minority of the ribbon is wound on the supply spool. The ribbon wound on the supply spool in the loaded condition extends into the space occupied by the ribbon wound on the take-up spool when the take-up spool is in the loaded condition.

17 Claims, 7 Drawing Sheets

U.S. PATENT DOCUMENTS

| | | | | |
|---|---|---|---|---|
| 4,990,008 | A * | 2/1991 | Hwang | 400/208 |
| 5,004,218 | A | 4/1991 | Sardano et al. | |
| 5,037,216 | A | 8/1991 | Nubson et al. | |
| 5,050,852 | A | 9/1991 | Sawada et al. | |
| 5,064,301 | A | 11/1991 | Nakamura et al. | |
| 5,102,116 | A | 4/1992 | Garavuso | |
| 5,220,355 | A | 6/1993 | Miyawaki | |
| 5,229,586 | A | 7/1993 | Ishii | |
| 5,301,834 | A | 4/1994 | Lee et al. | |
| 5,366,306 | A | 11/1994 | Mizutani et al. | |
| 5,453,852 | A | 9/1995 | Morikawa et al. | |
| 5,519,429 | A | 5/1996 | Zwijsen et al. | |
| 5,546,115 | A | 8/1996 | Nardone et al. | |
| 5,547,298 | A * | 8/1996 | Wouters et al. | 400/207 |
| 5,558,449 | A | 9/1996 | Morgavi | |
| 5,597,248 | A * | 1/1997 | Burgin | 400/207 |
| 5,739,835 | A | 4/1998 | Morgavi et al. | |
| 5,769,548 | A * | 6/1998 | Thompson et al. | 400/207 |
| 5,829,631 | A | 11/1998 | Kasper | |
| 5,895,157 | A | 4/1999 | Morimura et al. | |
| 5,904,546 | A | 5/1999 | Wood et al. | |
| 5,936,646 | A | 8/1999 | Kenny et al. | |
| 5,941,522 | A | 8/1999 | Hagstrom et al. | |
| 6,151,478 | A | 11/2000 | Katsuta et al. | |
| 6,261,012 | B1 | 7/2001 | Haas et al. | |
| 6,390,697 | B1 | 5/2002 | O'Mera et al. | |
| 6,422,554 | B1 | 7/2002 | Wuethrich et al. | |
| 6,486,904 | B1 | 11/2002 | Onozato et al. | |
| 6,550,761 | B1 | 4/2003 | Chiang | |
| 6,604,876 | B2 | 8/2003 | Bryant et al. | |
| 6,616,360 | B2 | 9/2003 | Lehmkuhl | |
| 6,626,298 | B2 | 9/2003 | Lax | |
| 6,626,594 | B1 * | 9/2003 | Lallemant | 400/589 |
| 6,682,241 | B2 | 1/2004 | Coons et al. | |
| 6,714,228 | B1 | 3/2004 | Holland et al. | |
| 6,827,509 | B2 | 12/2004 | Suden et al. | |
| 6,910,656 | B2 | 6/2005 | Lysiak et al. | |
| 7,018,117 | B2 | 3/2006 | Meier et al. | |
| 7,549,633 | B2 | 6/2009 | Nishitani et al. | |
| 2001/0046401 | A1 | 11/2001 | Lien et al. | |
| 2003/0025781 | A1 | 2/2003 | Honma et al. | |
| 2004/0109715 | A1 | 6/2004 | Meier et al. | |
| 2004/0114981 | A1 | 6/2004 | Meier et al. | |
| 2005/0078998 | A1 | 4/2005 | Lien et al. | |
| 2005/0095049 | A1 | 5/2005 | Yoshida et al. | |
| 2005/0242487 | A1 | 11/2005 | Pelletier et al. | |

FOREIGN PATENT DOCUMENTS

| | | | |
|---|---|---|---|
| JP | 07256755 | A | 10/1995 |
| JP | 10016186 | A | 1/1998 |
| WO | 2005096724 | A2 | 10/2005 |

OTHER PUBLICATIONS

Search Report and Written Opinion dated Jun. 26, 2008 for International Application No. PCT/US2008/001031.
Search Report and Written Opinion dated Jun. 26, 2008 for International Application No. PCT/US2008/002207.
Search Report and Written Opinion dated Jun. 4, 2008 for International Application No. PCT/US2008/000851.

* cited by examiner

CREDENTIAL PRODUCTION PRINT RIBBON AND TRANSFER RIBBON CARTRIDGES

CROSS-REFERENCE TO RELATED APPLICATIONS

This application incorporates herein by reference in their entirety the following applications filed on Mar. 8, 2007: U.S. patent application Ser. No. 11/683,771 entitled "SUBSTRATE FEEDING IN A CREDENTIAL PRODUCTION DEVICE" having inventors Ted M. Hoffman, Jeffrey L. Stangler, John P. Skoglund and Tony Nauth; U.S. patent application Ser. No. 11/683,795 entitled "CARD HOLDER FOR A CREDENTIAL PRODUCTION DEVICE" having inventors Ted M. Hoffman, Jeffrey L. Stangler and John P. Skoglund; U.S. patent application Ser. No. 11/683,827 entitled "PRINTHEAD ASSEMBLY FOR A CREDENTIAL PRODUCTION DEVICE" having inventor Ted M. Hoffman; U.S. patent application Ser. No. 11/683,835 entitled "CANTILEVERED CREDENTIAL PROCESSING DEVICE COMPONENT" having inventors Ted M. Hoffman and Thomas G. Gale Jr.; U.S. patent application Ser. No. 11/683,710 entitled "CREDENTIAL PRODUCTION DEVICE HAVING A UNITARY FRAME" having inventors Ted M. Hoffman and James R. Cedar; and U.S. patent application Ser. No. 11/683,850 entitled "INVERTED REVERSE-IMAGE TRANSFER PRINTING" having inventors Ted M. Hoffman, Jeffrey L. Stangler, John P. Skoglund, Thomas G. Gale Jr. and Tony Nauth.

FIELD OF THE INVENTION

The present invention is generally directed to a credential production device. More particularly, the present invention is directed to ribbon cartridges used in processing a credential substrate using a credential production device.

BACKGROUND OF THE INVENTION

Credential products include, for example, identification cards, driver's licenses, passports, and other valuable documents. Such credentials are formed from credential substrates including paper substrates, plastic substrates, cards and other materials. Such credentials generally include printed information, such as a photo, account numbers, identification numbers, and other personal information that is printed on the credential substrates using a print consumable, such as ink and ribbon.

Credential processing devices process credential substrates by performing at least one step in forming a final credential product. One type of credential production device is a reverse-image credential production device. Reverse-image credential production devices generally include a printing section and an image transfer section. The printing section utilizes an intermediate transfer film or transfer ribbon, a print ribbon and a printhead. The printhead is typically a thermal printhead that operates to heat different colored dye panels of a thermal print ribbon to transfer the colored dye from the print ribbon to a panel of transfer film to form the image thereon. After the printed image on the transfer film is registered with a substrate, a heated transfer roller of the image transfer section transfers the image from the transfer film or transfer ribbon to a surface of the substrate.

Conventional reverse-image credential production devices are typically large, cumbersome and complicated machines where improvements to these types of machines are in continuous demand. For example, there is a continuous demand for improving the process by which the print and transfer ribbons are loaded and positioned, while reducing the amount of space need for the print and transfer ribbons.

Embodiments of the present invention provide solutions to these and other problems, and offer other advantages over the prior art.

SUMMARY OF THE INVENTION

Embodiments of the invention are directed to ribbon cartridges for a credential production device. One embodiment of the ribbon cartridge includes a take-up spool, a supply spool and a ribbon wound on the supply and take-up spools. The supply spool includes a loaded condition, in which a majority of the ribbon is wound on the supply spool and a minority of the ribbon is wound on the take-up spool. The take-up spool includes a loaded condition, in which a majority of the ribbon is wound on the take-up spool and a minority of the ribbon is wound on the supply spool. The ribbon wound on the supply spool in the loaded condition extends into the space occupied by the ribbon wound on the take-up spool when the take-up spool is in the loaded condition.

In accordance with another embodiment, the ribbon cartridge includes a housing having a rear wall support and a front wall support that cooperate to form a supply spool receiver and a take-up spool receiver. A supply spool is supported by the supply spool receiver. The supply spool has an axis of rotation. A take-up spool is supported by the take-up spool receiver. The take-up spool has an axis of rotation. A ribbon is wound on the supply and take-up spools wherein the ribbon has a width. A plane extends across the width of the ribbon wound on each of the supply and the take-up spools and through the axes of rotation of take-up spool and the supply spool. The plane is unobstructed by the housing of the ribbon cartridge.

Embodiments of the invention also provide a method of feeding a ribbon from a supply spool to a take-up spool in a credential production device. The method provides the supply spool in a loaded condition. The loaded condition of the supply spool includes a majority of the ribbon being wound on the supply spool and a minority of the ribbon being wound on the take-up spool. In the method, ribbon is fed from the supply spool to the take-up spool until the take-up spool reaches a loaded condition. The loaded condition of the take-up spool includes a majority of the ribbon being wound on the take-up spool and a minority of the ribbon being wound on the supply spool such that the supply spool in the loaded condition extends into a space occupied by the ribbon wound on the take-up spool when the take-up spool is in the loaded condition. In addition, the take-up spool in the loaded condition extends into a space occupied by the ribbon wound on the supply spool when the supply spool is in the loaded condition.

DETAILED DESCRIPTION OF THE PREFERRED EMBODIMENTS

Figure 1:
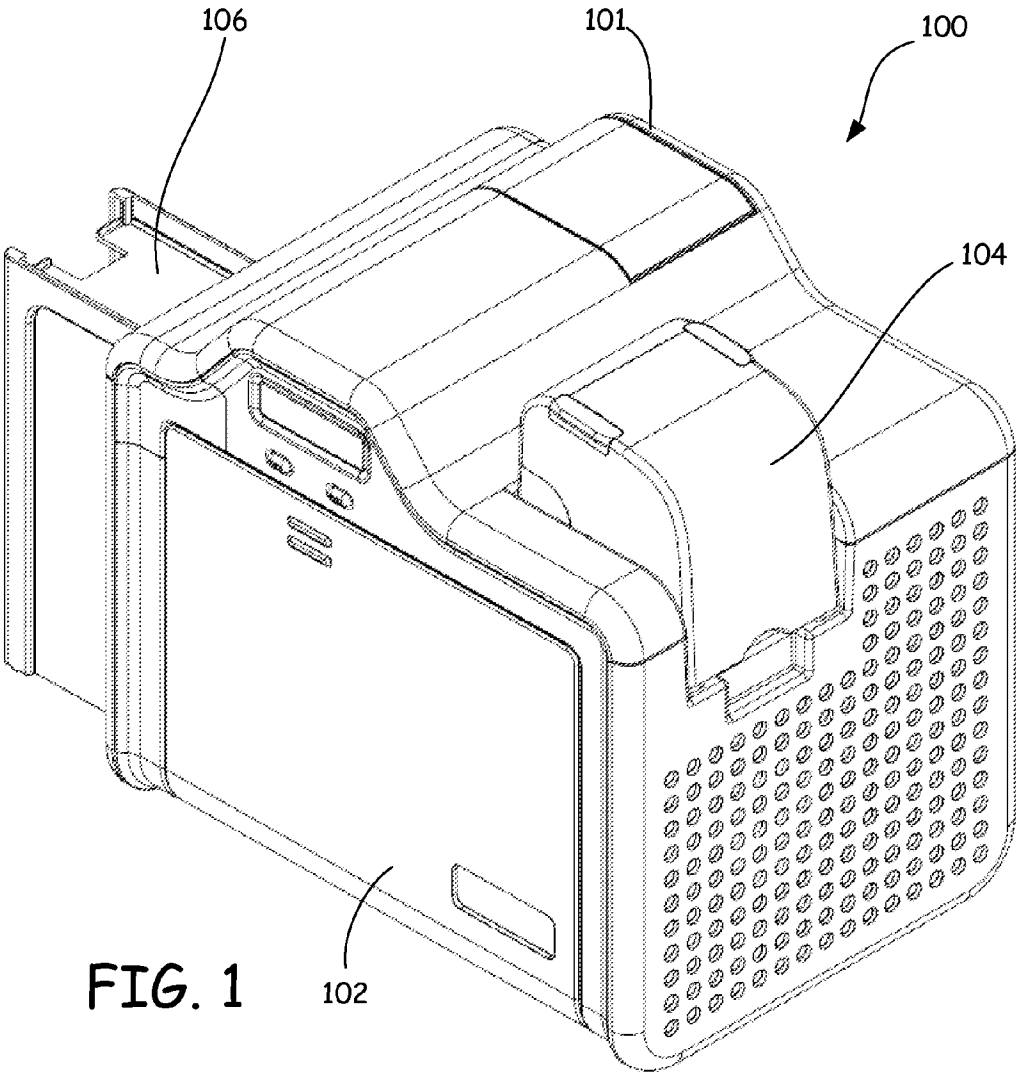
FIG. 1 is a perspective view of a credential production device under embodiments of the invention.
Figure 2:
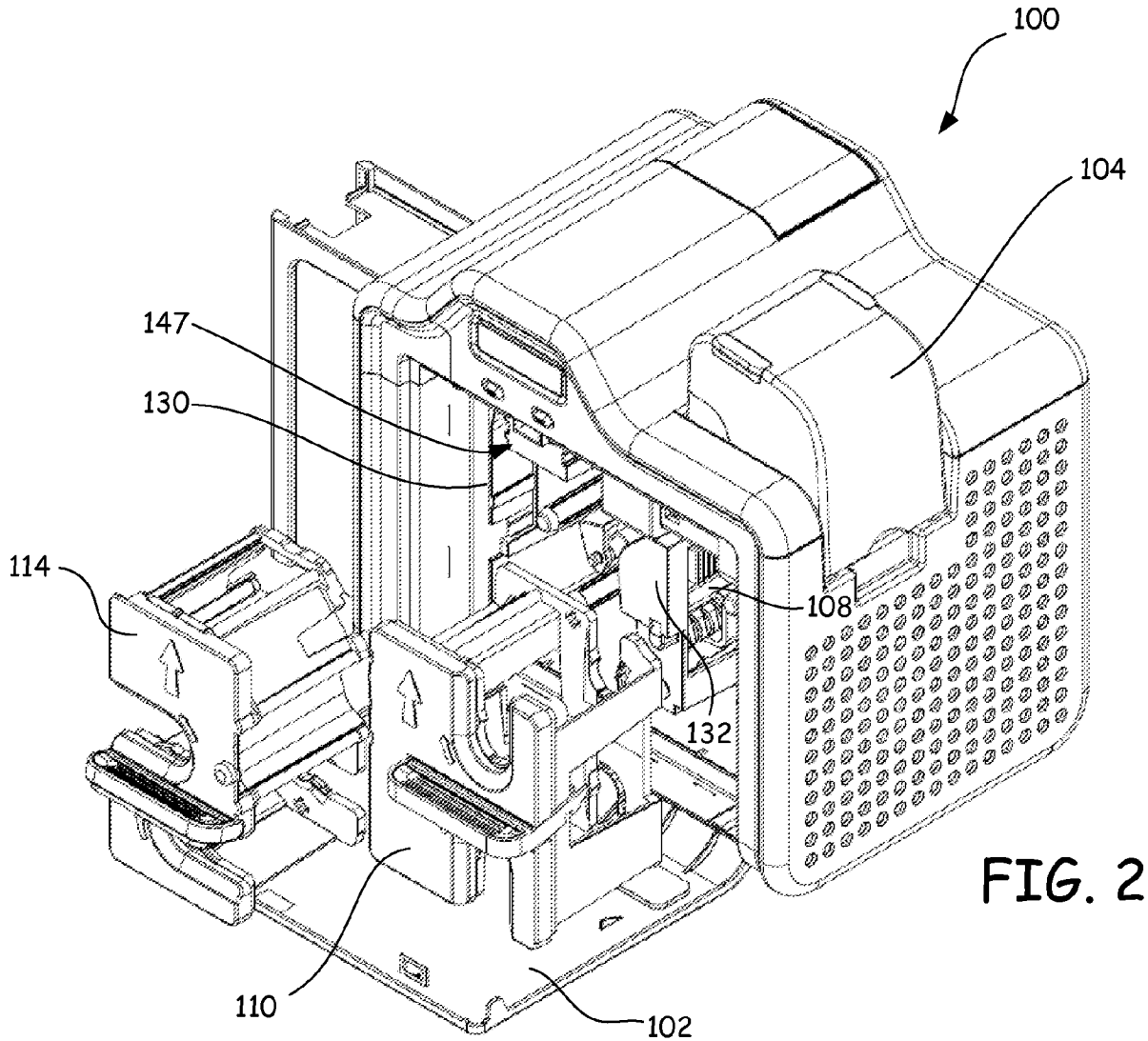
FIG. 2 is an exploded perspective view of the credential production device of FIG. 1.
Figure 3:
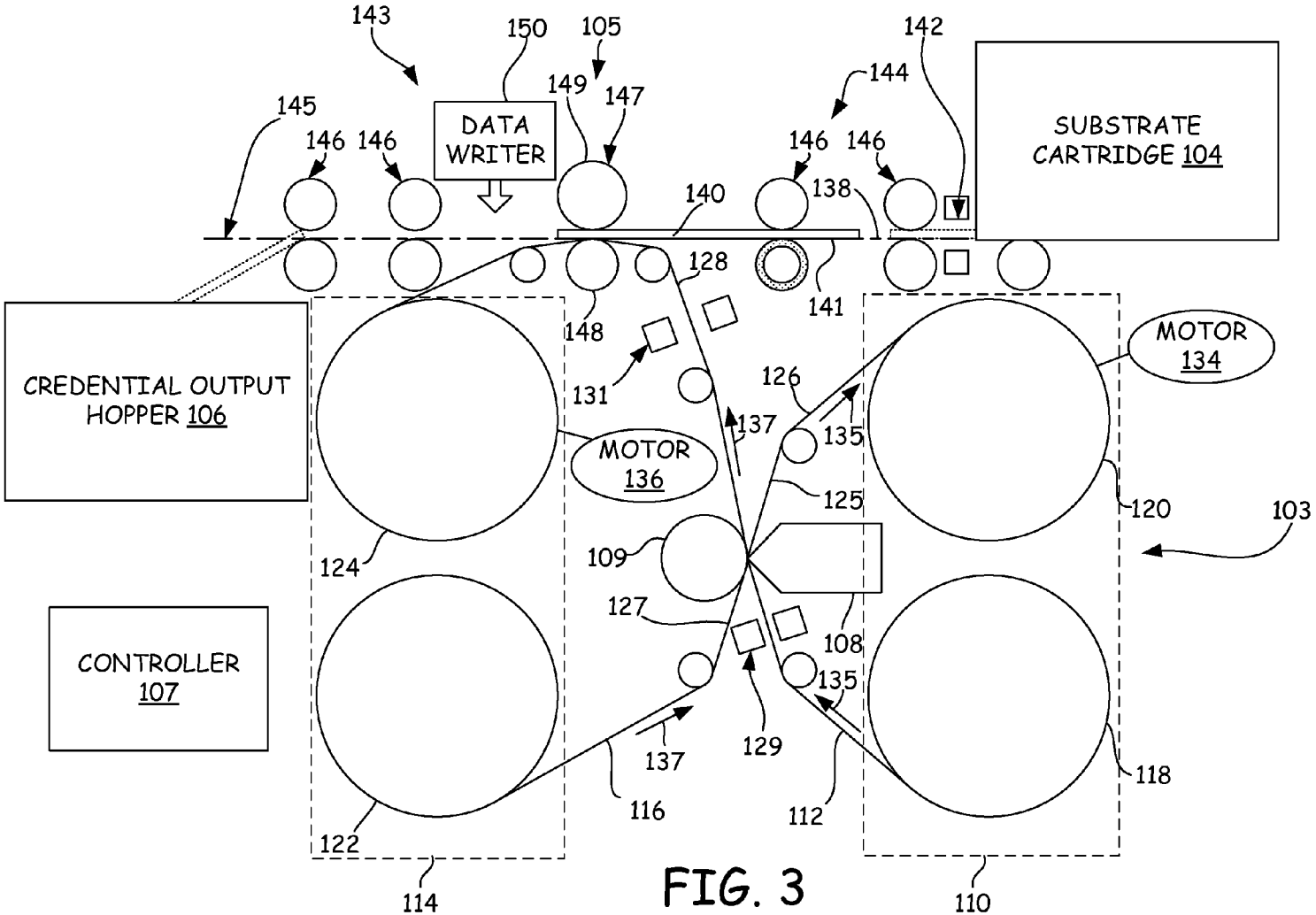
FIG. 3 is a simplified schematic diagram of the credential production device illustrated in FIGS. 1 and 2.

FIGS. 1 and 2 illustrate perspective views of a credential production device 100. FIG. 1 illustrates an exterior view of credential production device 100 and FIG. 2 illustrates an exploded view of credential production device 100. FIG. 3 illustrates a simplified schematic diagram of device 100 in accordance with embodiments of the invention.

Embodiments of the disclosure pertain to credential production device 100 as being a reverse-image printer and, therefore, embodiments of the disclosure pertain to the use of ribbon and film cartridges in a reverse-image printer. However, it should be understood that embodiments of film cartridges of the disclosure can also be used in other types of credential production devices such as non-reverse-image credential printing devices and in credential laminating devices. Before discussing embodiments of the ribbon/film cartridges in detail, components of credential production device 100 will be briefly described.

Credential production device 100 provides inverted reverse image transfer printing using production components that are inverted relative to a position of production components in a conventional reverse-image production device with respect to a processing path. Unlike conventional production devices, the inverted nature of credential production device 100 located production components below its processing path. This configuration allows credential production device 100 to be formed more compactly, especially in height, than conventional credential production devices as well as simplifies a processing path of which a credential substrate is transported.

In the embodiments illustrated in FIGS. 1 and 2, credential production device 100 includes an enclosure 101 having a front panel 102. Credential production device 100 utilizes a substrate cartridge 104, a substrate transport mechanism and a credential output hopper 106. In addition to the location of production components in credential production device 100 being below processing path 138 (FIG. 3), configurations of many production components within credential production device 100 allow the device to be more compact than conventional credential production devices.

In FIG. 2, front panel 102 is removed to more clearly describe main production components internal to credential production device 100, and FIG. 3 also illustrates a simplified schematic diagram of various production components internal to credential production device 100 that are not easily shown in FIG. 2. In general, credential production device 100 includes a printing section 103 and an image transfer section 105. A controller 107 generally controls the components of credential production device 100 to perform various operations including printing, imaging transfer, sensor calibration and other operations.

In one embodiment, printing section 103 includes a printhead 108, a print platen 109, a print ribbon cartridge 110 for supporting a print ribbon 112 and a transfer ribbon cartridge 114 for supporting a transfer ribbon 116. As illustrated in FIG. 2, cartridges 110 and 114 are releasable and removable from credential production device 100 for loading and unloading print ribbon 112 and transfer ribbon 116. Print ribbon 112 (e.g., dye sublimation print ribbon) is wound about a supply spool 118 and a take-up spool 120. Transfer ribbon 116 is wound about a supply spool 122 and a take-up spool 124. Print ribbon 112 includes a first side 125 and a second side 126 opposite the first side. When print ribbon 112 is wound about spools 118 and 120, first side 125 faces the interior of print ribbon cartridge 110 and second side 126 faces transfer ribbon cartridge 114. Transfer ribbon 116 includes a first side 127 and a second side 128 opposite the first side. When transfer ribbon 116 is wound about spools 122 and 124, first side 127 faces the interior of transfer ribbon cartridge 114 and second side 128 faces print ribbon cartridge 110.

In one embodiment, credential production device 100 includes an internal frame 130 that is configured to house print ribbon cartridge 110 and transfer ribbon cartridge 114 after print ribbon 112 is loaded onto print ribbon cartridge 110, after transfer ribbon 116 is loaded onto transfer ribbon cartridge 114 and both cartridges are inserted into credential production device 100. When print ribbon cartridge 110 is inserted into internal frame 130 of credential production device 100, embodiments of print ribbon cartridge 110 also receive a printhead housing 132 contained in internal frame 130. Printhead housing 132 houses printhead 108. Print ribbon cartridge 110 allows printhead 108 to rotate about a rotation path such that burn elements on printhead 108 faces and apply pressure on print platen 109 and therefore places second side 126 of print ribbon 112 in contact with second side 128 of transfer ribbon 116.

In one embodiment, credential production device 100 includes a print ribbon sensor 129 and a transfer ribbon sensor 131. Print ribbon sensor 129 detects different color frames or panels of print ribbon 112. The frames or panels repeat in a sequence or group consisting of a yellow, magenta and cyan frames or panels. In addition, the print ribbon can include a black resin frame or panel in the sequence of color frames or panels, if desired. Print ribbon sensor 129 detects the colored frames or panels for controller 107, which uses signals derived from the sensed frames or panels to control motor 134. Motor 134 feeds print ribbon 112 in a direction indicated by arrows 135. Transfer ribbon sensor 131 is configured to sense transition marks (not illustrated) that separate substantially clear or transparent panels along the length of transfer ribbon 116. Transfer film sensor 131 detects the transition marks for the controller 107, which uses signals derived from the sensed transition marks to control motor 136. Motor 136 feeds transfer ribbon 116 in a direction indicated by arrows 137.

While motors 134 and 136 are operating, printhead 108 applies pressure against print platen 109 such that printhead 108 is in contact with first side 125 of print ribbon 112 and brings print ribbon 112 in contact with second side 128 of transfer ribbon 116. In one embodiment, printhead 108 is a thermal printhead having burn elements. The burn element on printhead 108 transfers a reverse image onto a panel of transfer ribbon 116 using print ribbon 112. Printhead 108 prints each panel of transfer ribbon 116 while oriented approximately perpendicularly to a credential substrate path 138. The reverse image on the panel of transfer ribbon 116 is then moved towards credential substrate path 138 for transferring the reverse image to a credential substrate 140.

In another embodiment, image transfer section 105 includes a substrate input 142, a substrate transport 143, a transfer mechanism 144 and a substrate output 145. Credential substrates 140 are received by substrate transport 143 from substrate cartridge 104 at substrate input 142. Substrate transport 143 feeds credential substrates 140 individually along substrate path 138. Substrate path 138 is substantially flat between substrate input 142 and substrate output 145 to avoid any bending or damaging of substrates 140, particularly when they are in the form of rigid or semi-rigid plastic substrates used for identification cards. Substrate transport 143 includes substrate feed rollers 146 that are driven by a motors through gear and pulley arrangements. It should be noted that in some embodiments separate motors can be used for different stages of substrate transport through credential production device 100. For example, a motor can be used to drive the feeding of a substrate 140 through substrate input 142 and another motor can be used to drive the feeding of substrate 140 through the remaining substrate path 138 in credential production device 100.

When transfer ribbon cartridge 114 is inserted into credential production device 100, as previously discussed, embodiments of transfer ribbon cartridge 114 also engagingly receive a transfer roller assembly 147 (FIG. 2) that includes transfer roller 148 illustrated in FIG. 3. Transfer ribbon cartridge 114 allows transfer roller assembly 147 to move and therefore allows transfer roller 148 to apply pressure on a platen 149. During image transfer, transfer roller 148 is in contact with first side 127 of transfer ribbon 116 and presses transfer ribbon 116 and substrate 140 against platen 149 such that the reverse image printed on transfer ribbon 116 is transferred onto a bottom side 141 of substrate 140. Transfer roller 148 uses heat and pressure to transfer the reverse image printed on transfer ribbon 116 onto substrate 140.

In one embodiment, the credential production device 100 includes a data reader/writer 150 configured to read and/or write data to the substrate 140. Exemplary data reader/writers 150 include magnetic stripe reader/writers configured to read data from and/or write data to a magnetic stripe on the credential substrate 140, a bar code reader/writers configured to read data from a barcode on the substrate 140 and/or write data to the barcode on the substrate 140, a memory reader/writer, such as a smartcard encoder, configured to read data from a memory of the substrate 140 and/or write data to the memory of the substrate 140, and other data reader/writers. In one embodiment, the data reader/writer 150 is positioned above the processing path 138 and is configured to read and/or write data at a top surface of the substrate 140.

Figure 4:
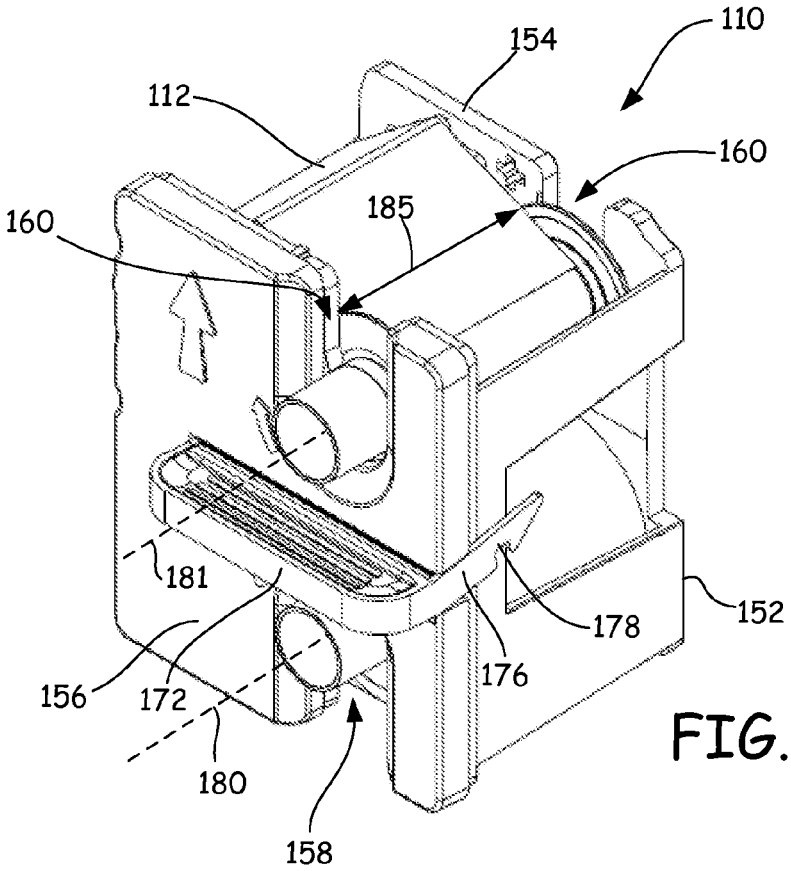
FIG. 4 illustrates a front perspective view of a print ribbon cartridge including loaded print ribbon under embodiments of the invention.
Figure 5:
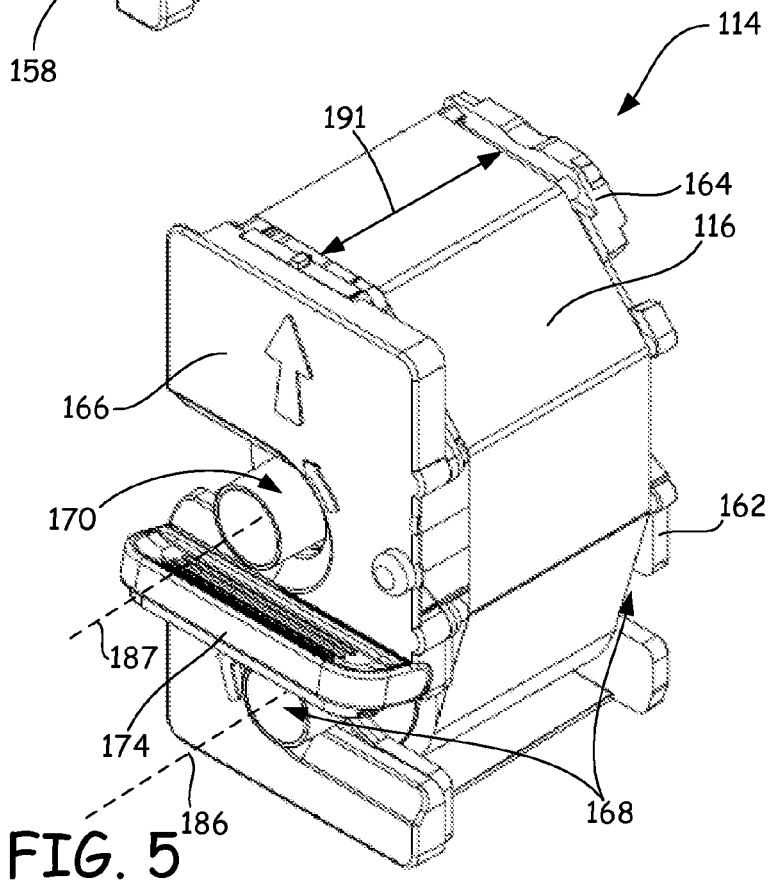
FIG. 5 illustrates a front perspective view of a transfer ribbon cartridge including loaded transfer ribbon under embodiments of the invention.

FIG. 4 illustrates a front perspective view of an embodiment of print ribbon cartridge 110 loaded with print ribbon 112. Print ribbon cartridge 110 includes a housing 152 having a rear wall support 154 and a front wall support 156. Rear wall support 154 and front wall support 156 cooperate to form a supply spool receiver 158 and a take-up spool receiver 160. FIG. 5 illustrates a front perspective view of an embodiment of transfer ribbon cartridge 114 loaded with transfer ribbon 116. Transfer ribbon cartridge 114 includes a housing 162 having a rear wall support 164 and a front wall support 166. Rear wall support 164 and front wall support 166 cooperate to form a supply spool receiver 168 and a take-up spool receiver 170. As illustrated in FIGS. 4 and 5, embodiments of both print ribbon cartridge 110 and transfer ribbon cartridge 114 include handles 172 and 174, respectively. Handle 172 is coupled to an outer surface of the front support wall 156 of housing 152. Handle 174 is coupled to an outer surface of front support wall 166 of housing 162. Although not illustrated in FIG. 5, in some embodiments both handle 172 and handle 174 have an arm 176 (FIG. 4) formed with each handle. For print ribbon cartridge 110, arm 176 is located on the side of the print ribbon cartridge 110 that is opposite transfer film cartridge 114 when the cartridges are inserted into internal frame 130 (FIG. 2) of credential production device 100. Likewise, the arm included in transfer ribbon cartridge 114 is located opposite print ribbon cartridge 110 when the cartridges are inserted into internal frame 130 of credential production device 100. In some embodiments, each arm 176 includes a latch 178. Each latch 178 is configured to latch to a portion of internal frame 130 of credential production device 100. Each handle 172 and 174 and therefore each latch 178 includes a locked position and a release position. Each handle 172 and 174 and therefore each latch 178 are biased in a locked position. In FIG. 4, handle 172 and therefore latch 178 is illustrated as being in a release position, while in FIG. 5, handle 174 and therefore its corresponding latch (hidden from view) are illustrated as being in a locked position. Therefore, when inserting either print ribbon cartridge 110 or transfer ribbon cartridge 114 into internal frame 130 of credential production device 100, an operator will depress handle 172 or 174 such that latch 178, for example, is in a release position. After either print ribbon cartridge 110 or transfer ribbon cartridge 114 are inserted into internal frame 130 of credential production device 100, the operator releases their grip from handle 172 or 174 such that latch 178, for example, will bias into the locked position.

Figure 6:
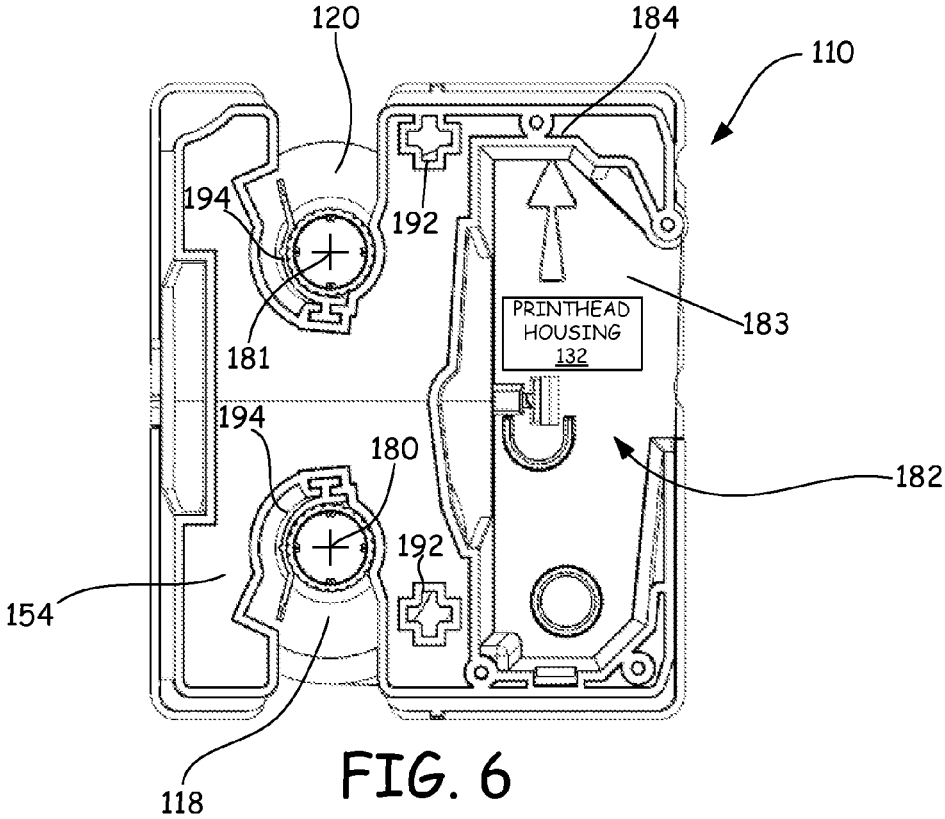
FIG. 6 illustrates a rear plan view of a print ribbon cartridge including loaded print ribbon under embodiments of the invention.

FIG. 6 illustrates a rear plan view of an embodiment of print ribbon cartridge 110 including a supply spool 118 and take-up spool 120 having print ribbon 112 loaded into print ribbon cartridge 110. FIG. 6 illustrates supply spool 118 positioned in supply spool receiver 158 (FIG. 4) and take-up spool 120 positioned in take-up spool receiver 160 (FIG. 4). Supply spool 118 includes an axis of rotation 180 (also illustrated in FIG. 4) and take-up spool 120 includes an axis of rotation 181 (also illustrated in FIG. 4). In some embodiments, print ribbon cartridge 110 also includes a printhead housing receiver 182. Printhead housing receiver 182 is configured to receive printhead housing 132 (also illustrated in FIG. 2) when print ribbon cartridge 110 is inserted into internal frame 130 of credential production device 100 (FIG. 2). Printhead housing receiver 182 includes a first end 183 that includes front support wall 156 (FIG. 4) and a second end opposite the first end that is open. Printhead housing receiver 182 also includes opposing side ends that are open, a bottom end that is open and a top end 184 that includes a plurality of guides and rollers for feeding print ribbon 112 from supply spool 118 to take-up spool 120. However, one of the opposing open sides ends is where a width 185 (FIG. 4) of print ribbon 112 extends from front support wall 156 to rear support wall 154 (FIG. 4) of print ribbon cartridge 110. Although not fully illustrated in either FIG. 4 or 6, embodiments of print ribbon cartridge 110 include a plane that extends across the width 185 of the print ribbon 112 that is wound about supply spool 118 and take-up spool 120. The plane extends through the axes of rotation 180 and 181 of supply spool 118 and take-up spool 120. The plane is not obstructed by any portion of housing 152 (FIG. 4) of print ribbon cartridge 110. The plane has a thickness greater than approximately ⅕ inch. In other embodiments, the thickness of the plane is greater than ¼ inch or greater than ½ inch.

Figure 7:
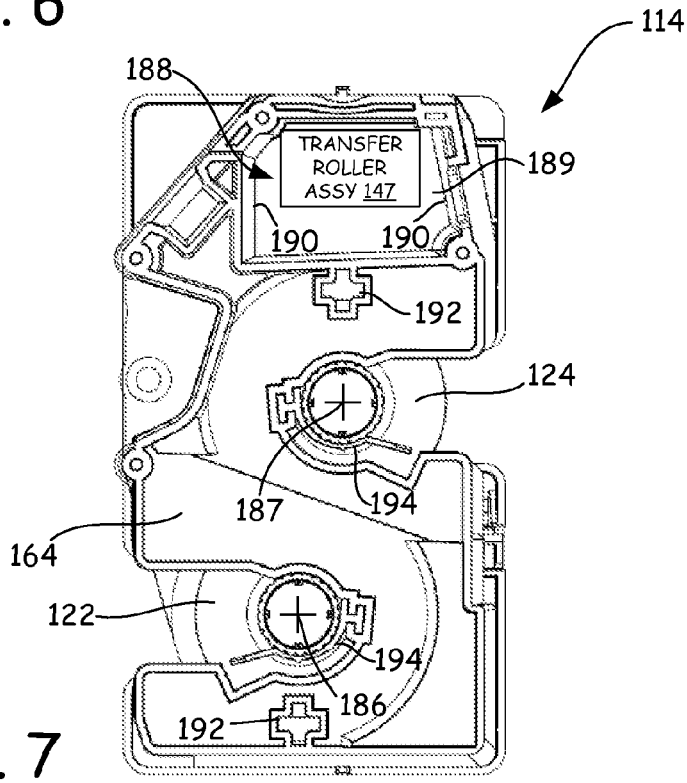
FIG. 7 illustrates a rear plan view of a transfer ribbon cartridge including loaded transfer ribbon under embodiments of the invention.

FIG. 7 illustrates a rear plan view of an embodiment of transfer ribbon cartridge 114 including a supply spool 122 and a take-up spool 124 having transfer ribbon 116 loaded into transfer ribbon cartridge 114. FIG. 7 illustrates supply spool 122 positioned in supply spool receiver 168 (FIG. 5) and take-up spool 124 positioned in take-up spool receiver 170 (FIG. 5). Supply spool 122 includes an axis of rotation 186 (also illustrated in FIG. 5) and take-up spool 124 includes an axis of rotation 187 (also illustrated in FIG. 5). In some embodiments, transfer ribbon cartridge 114 includes a transfer roller housing 188. Transfer roller housing 188 is configured to receive transfer roller assembly 147 (also illustrated in FIGS. 2 and 3) when transfer ribbon cartridge 114 is inserted into internal frame 130 (FIG. 2) of credential production device 100. Transfer roller housing 188 includes a first end 189 that includes front support wall 166 (FIG. 5) and a second end opposite the first end that is open. Transfer roller housing 188 also includes opposing sidewalls 190, an open top end where a width 191 (FIG. 5) of transfer ribbon 116 extends between front support wall 166 to rear support wall 164 and an open bottom end. Although not fully illustrated in either FIG. 5 or 7, embodiments of transfer ribbon cartridge 114 include a plane that extends across the width 191 of the transfer ribbon 116 that is wound about supply spool 122 and take-up spool 124. The plane extends through the axes of rotation 186 and 187 of supply spool 122 and take-up spool 124. The plane is not obstructed by any portion of housing 162 (FIG. 5) of transfer ribbon cartridge 114. The plane has a thickness greater than approximately ⅕ inch.

In some embodiments and as illustrated in FIGS. 6 and 7, both cartridges 110 and 114 include crosshair apertures 192. Crosshair apertures 192 extend into housing 152 and housing 162. When print ribbon cartridge 110 and transfer ribbon cartridge 114 are inserted into internal frame 130 (FIG. 2) of credential production device 100, the crosshair apertures are configured to receive protuberances that extend from the credential production device 100. By receiving protuberances that extend from credential production device 100, print ribbon cartridge 110 and transfer ribbon cartridge 114 are both properly aligned within credential production device 100.

As previously discussed, rear wall support 154 and front wall support 156 of print ribbon cartridge 110 cooperate to form a supply spool receiver 158 and take-up spool receiver 160 as illustrated in FIG. 4 and rear wall support 164 and front wall support 166 of transfer ribbon cartridge 114 cooperate to form supply spool receiver 168 and take-up spool receiver 170 as illustrated in FIG. 5. In some embodiments of cartridges 110 and 114, both supply spool receivers 158 and 168 and take-up spool receiver 160 and 170 of print ribbon cartridge 110 and transfer ribbon cartridge 114 include a pair of retaining clips 194 on their rear wall supports 154 and 164.

Figure 8:
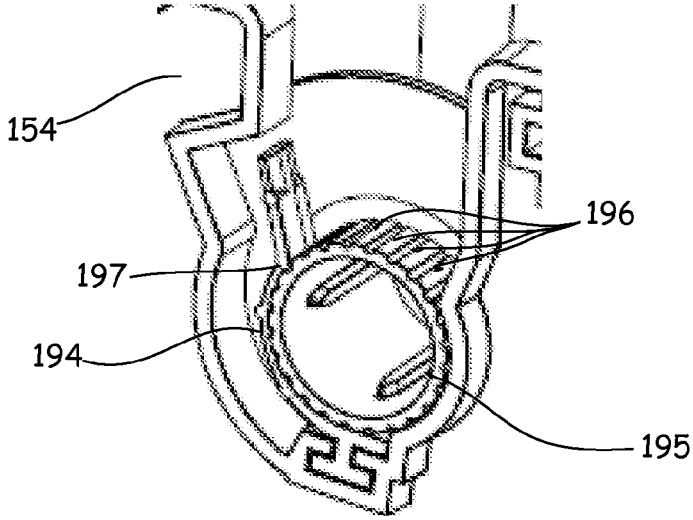
FIG. 8 illustrates an enlarged view of a clip for supporting a spool under embodiments of the invention.

FIG. 8 illustrates an enlarged view of an exemplary clip 194 located on rear wall support 154 of print ribbon cartridge 110. Example clip 194 includes a support position and a release position. It should be noted for purposes of clarity, although previously discussed, that clip 194 is not the only clip included in credential production device 100 and that similar clips can be located on rear support wall 164 of transfer ribbon cartridge 114. In this example, FIG. 8 illustrates supply spool 118 having a core 195 of which a supply of print ribbon 112 can be wound about. Each core 195 includes a plurality of teeth 196. In a support position, each of the plurality of teeth 196 engages a lip 197 of the clip 194. The support position aids in keeping the ribbon, such as print ribbon 112 in this example, taunt. Upon rotation of core 195 of supply spool 118, the lip 197 of the clip 194 is in a release position between each tooth to allow the core 195 to rotate. Embodiments of clip 194 comprise a material that is less rigid than a material of supply spool 118 and front wall support 154 of print ribbon cartridge 110. For example, supply spool 118 and rear support wall 154 can be made of a polycarbonate, while clip 94 can be made of nylon. Having clip 194 made of a less rigid material provides the clip with a springing action such that the clip easily switches between the release position and the support position.

Figure 9:
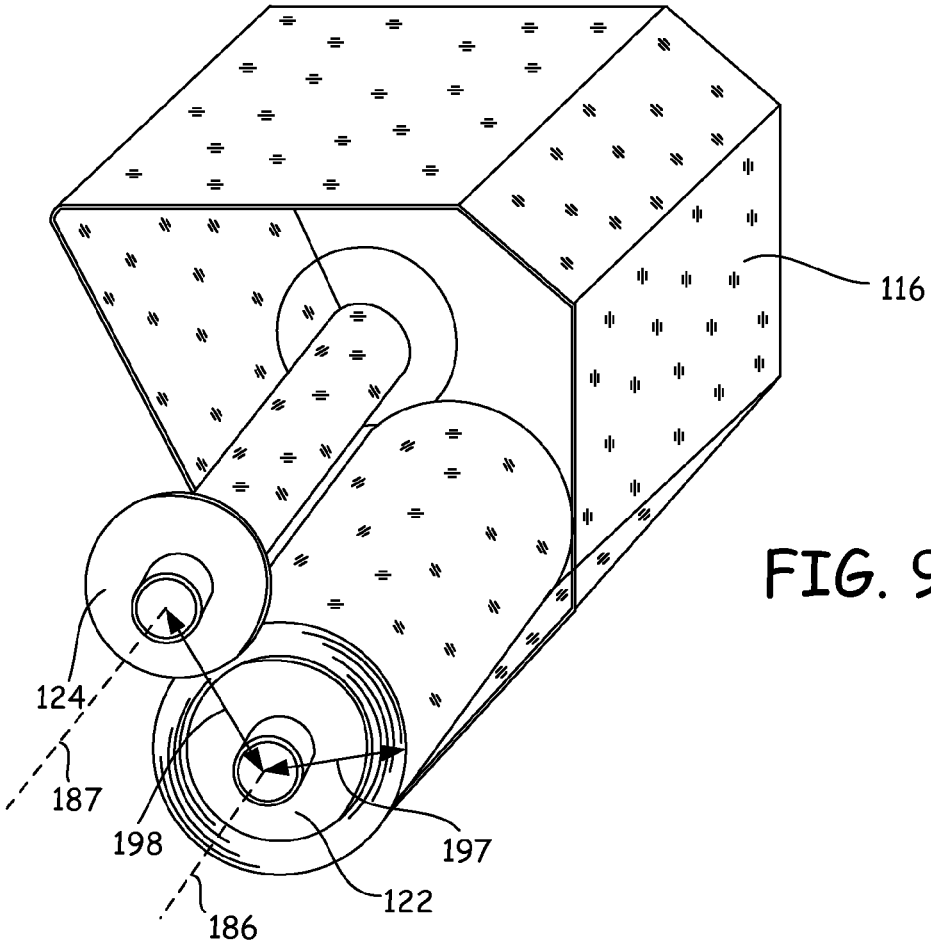
FIG. 9 illustrates a perspective view of a ribbon loaded on a supply spool and a take-up spool, in which the supply spool is in a loaded condition under embodiments of the invention.
Figure 10:
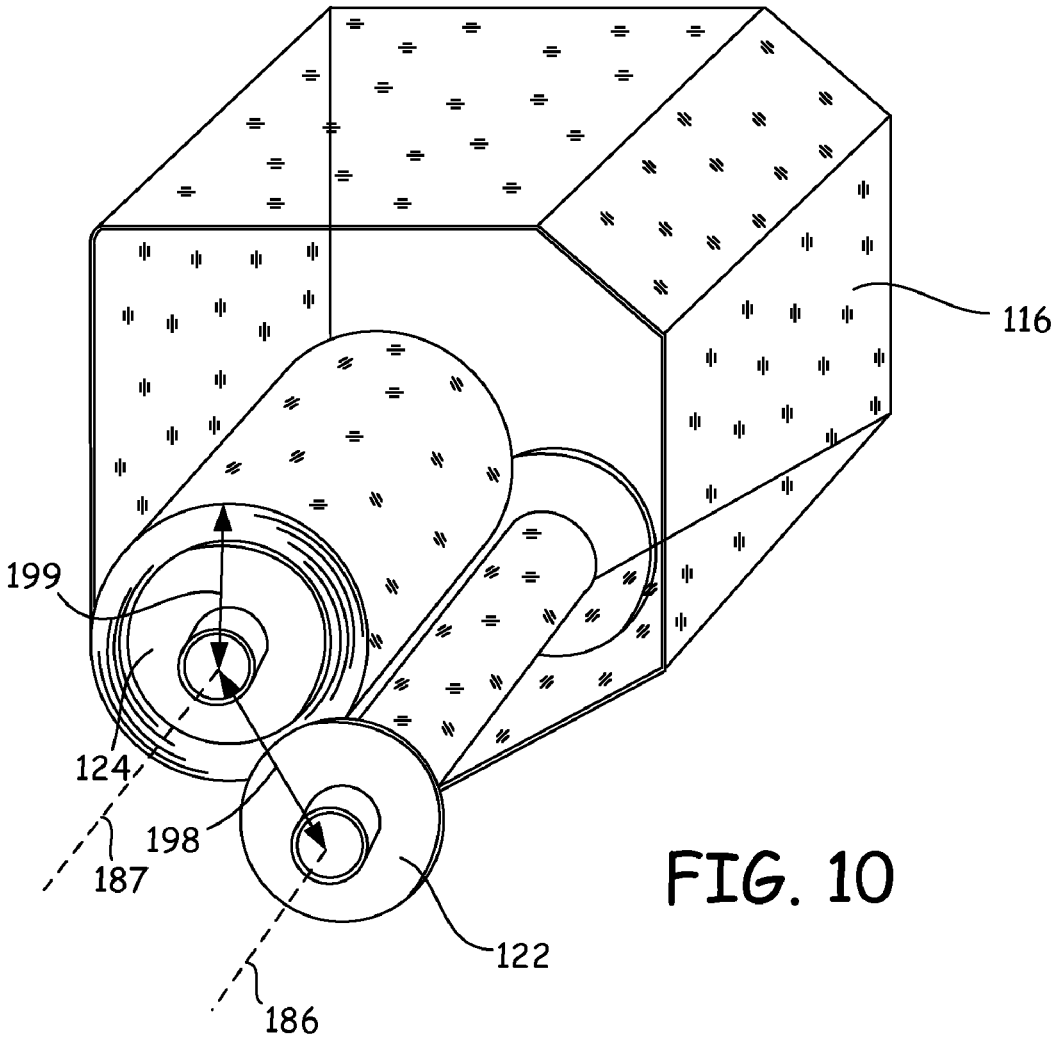
FIG. 10 illustrates a perspective view of a ribbon loaded on a supply spool and a take-up spool, in which the take-up spool is in a loaded condition under embodiments of the invention.

FIG. 9 illustrates transfer ribbon 116 loaded on supply spool 122 and take-up spool 124 as if the supply spool 122 and the take-up spool 124 were loaded in transfer ribbon cartridge 114 (FIGS. 5 and 7). Supply spool 122 has axis of rotation 186 and take-up spool 124 has axis of rotation 187. Transfer ribbon cartridge 114 has been removed from the figure for purposes of clarity. In FIG. 9, embodiments of transfer ribbon cartridge 114 include supply spool 122 in a loaded condition. A loaded condition of the supply spool 122 is one in which a majority of transfer ribbon 116 is wound on supply spool 122 and a minority of transfer ribbon 116 is wound on take-up spool 124 at any given point during the feeding of transfer ribbon 116 from supply spool 122 to take-up spool 124. FIG. 10 illustrates transfer ribbon 116 loaded on supply spool 122 and take-up spool 124 as if the supply spool 122 and the take-up spool 124 were loaded in transfer ribbon cartridge 114 (FIGS. 5 and 7). Supply spool 122 has axis of rotation 186 and take-up spool 124 has axis of rotation 188. Transfer ribbon cartridge 114 has been removed from the figure for purposes of clarity. In FIG. 10, embodiments of transfer ribbon cartridge 114 include take-up spool 124 in a loaded condition. A loaded condition of the take-up spool 124 is one in which a majority of transfer ribbon 116 is wound on the take-up spool 124 and a minority of transfer ribbon 116 is wound on supply spool 122 at any given point during the feeding of transfer ribbon 116 from supply spool 122 to take-up spool 124.

As illustrated in FIG. 9, supply spool 122 is closely positioned adjacent take-up spool 124 such that transfer ribbon 116 wound on the supply spool 122 in the loaded condition extends into the space occupied by transfer ribbon 116 wound on the take-up spool 124 when the take-up spool is in the loaded condition. As illustrated in FIG. 10, supply spool 122 is closely positioned adjacent take-up spool 124 such that transfer ribbon 116 wound on the take-up spool 124 in the loaded condition extends into the space occupied by transfer ribbon 116 wound on the supply spool 122 when the supply spool is in the loaded condition. As illustrated in both FIGS. 9 and 10, supply spool 122 and take-up spool 124 are positioned closely enough that a distance 198 between axis of rotation 186 of supply spool 122 and axis of rotation 188 of take-up spool 124 is less than twice a radius 197 of transfer ribbon 116 wound on the supply spool 122 in the loaded condition (FIG. 9) or a radius 199 of transfer ribbon 116 wound on the take-up spool 124 in the loaded condition (FIG. 10).

Although the present invention has been described with reference to preferred embodiments, workers skilled in the art will recognize that changes may be made in form and detail without departing from the spirit and scope of the invention.

What is claimed is:

1. A ribbon cartridge for use in a credential production device comprising:

a take-up spool;

a supply spool;

a ribbon wound on the supply and take-up spools;

a cartridge housing having at least a rear wall support and an opposing front wall support, each of the rear and front wall supports having a first support portion and a second support portion, the first support portions of the rear and front wall supports cooperate to form a supply spool receiver and the second support portions of the rear and front wall supports cooperate to form a take-up spool receiver, wherein the supply spool receiver and the take-up spool receiver of the front and rear walls receive and support the supply spool and the take-up spool, respectively; and a handle attached to and extending outwardly from an outer surface of the front wall, the handle having an arm and a latch formed with a same material as the handle, the latch extending from the arm along an exterior side of the housing between the front wall support and the rear wall support to secure the ribbon cartridge into a credential production device enclosure, the arm and latch configured into one of a locked position and a release position where the arm and latch are biased in the locked position.

2. The ribbon cartridge of claim 1, wherein:

the supply spool includes a loaded condition, in which a majority of the supply of ribbon is wound on the supply spool and a minority of the ribbon is wound on the take-up spool;

the take-up spool includes a loaded condition, in which a majority of the ribbon is wound on the take-up spool and a minority of the ribbon is wound on the supply spool;

the ribbon wound on the supply spool in the loaded condition extends into the space occupied by the ribbon wound on the take-up spool when the take-up spool is in the loaded condition; and the ribbon wound on the take-up spool in the loaded condition extends into the space occupied by the ribbon wound on the supply spool when the supply spool is in the loaded condition.

3. The ribbon cartridge of claim 2, wherein the supply spool includes an axis of rotation and the take-up spool includes an axis of rotation, wherein a distance from the axis of rotation of the supply spool and the axis of rotation of the take-up spool is less than approximately twice a radius of one of the ribbon wound on the supply spool in the loaded condition and the ribbon wound on the take-up spool in the loaded condition.

4. The ribbon cartridge of claim 1, wherein each of the take-up spool receiver and the supply spool receiver comprises a clip, each clip having a release position and a support position.

5. The ribbon cartridge of claim 4, wherein each outer surface of a core of the supply spool and a core of the take-up spool at least partially includes a plurality of teeth, wherein the teeth engage the clip in the support position.

6. The ribbon cartridge of claim 5, wherein each clip comprises a material that is less rigid than a material of the supply spool receiver and the take-up spool receiver.

7. A method of feeding a ribbon from a supply spool to a take-up spool in a credential production device, the method comprising:

providing a ribbon cartridge housing including a supply spool receiver for supporting a supply spool and a take-up spool receiver for supporting a take-up spool, the take-up spool having a core with a plurality of teeth and the supply spool having a core with a plurality of teeth;

providing a clip in each of the supply spool receiver and the take-up spool receiver, the clip having a lip that when in a retaining position engages with each tooth of each core to retain each spool and when in a release position disengages with each tooth of each core to allowing rotation of each spool; and feeding the ribbon from the supply spool to the take-up spool such that the lip of each clip alternately engages with each tooth to hold the ribbon taut and disengages with each tooth to allow each core to rotate until the take-up spool reaches a loaded condition, in which a majority of the ribbon is wound on the take-up spool and a minority of the ribbon is wound on the supply spool.

8. The method of claim 7, further comprising:

wherein the housing includes an outer surface having a latch that has a locked position and release position;

loading the ribbon cartridge into the credential production device by grasping a handle coupled to the latch such that the latch is in the release position; and locking the ribbon cartridge into the credential production device by releasing the latch into the locked position.

9. The method of claim 8, further comprising:

unloading the ribbon cartridge from the credential production device by grasping the handle such that the latch is in the release position.

10. A ribbon cartridge for feeding ribbon in a credential production device comprising:

a housing having a rear wall support and a front wall support that cooperate to form a supply spool receiver and a take-up spool receiver;

a supply spool supported by the supply spool receiver, the supply spool having a core with a plurality of teeth;

a take-up spool supported by the take-up spool receiver, the take-up spool including a core having a surface at least partially comprised of a plurality of teeth;

a clip located in each of the supply spool receiver and the take-up spool receiver, the clip having a lip that when in a retaining position engages with each tooth of each core to retain each spool and when in a release position disengages with each tooth of each core to allow rotation of each spool; and wherein the ribbon is fed from the supply spool to the take-up spool such that the lip of each clip alternately engages with each tooth to hold the ribbon taut and disengages with each tooth to allow each core to rotate.

11. The ribbon cartridge of claim 10 wherein:

the supply spool includes a loaded condition, in which a majority of the ribbon is wound on the supply spool and a minority of the ribbon is wound on the take-up spool;

the take-up spool includes a loaded condition, in which a majority of the ribbon is wound on the take-up spool and a minority of the ribbon is wound on the supply spool; and the ribbon wound on the supply spool in the loaded condition extends into the space occupied by the ribbon wound on the take-up spool when the take-up spool is in the loaded condition.

12. The ribbon cartridge of claim 11 wherein:

the ribbon wound on the take-up spool in the loaded condition extends into the space occupied by the ribbon wound on the supply spool when the supply spool is in the loaded condition.

13. The ribbon cartridge of claim 12 wherein a distance from the axis of rotation of the supply spool and the axis of rotation of the take-up spool is less than twice a radius of one of the ribbon wound on the supply spool in the loaded condition and the ribbon wound on the take-up spool in the loaded condition.

14. The ribbon cartridge of claim 10, wherein each clip comprises a material that is less rigid than a material of the supply spool receiver and the take-up spool receiver.

15. A consumable supply comprising:

a supply spool having a core, wherein at least a radial outer surface at both ends of the core are comprised of a plurality of teeth;

a take-up spool having a core, wherein at least a radial outer surface of both ends of the core are comprised of a plurality of teeth; and a ribbon wound on the supply and take-up spools.

16. The consumable supply of claim 15, wherein the supply spool and the take-up spool are configured for receipt by a ribbon cartridge.

17. The consumable supply of claim 16, wherein the teeth of the supply spool and the teeth of the take-up spool engage with a lip on clip attached to the ribbon cartridge such that the lip alternately engages with each tooth to hold the ribbon taut and disengages with each tooth to allow the spool to rotate.

* * * * *